US005193119A

United States Patent [19]

Tontini et al.

[11] Patent Number: 5,193,119

[45] Date of Patent: Mar. 9, 1993

[54] MULTIPLE LOUDSPEAKER

[76] Inventors: Franco Tontini, Via G. Matteotti, 41/A, Falconara Marittima (AN); Carlo Sancisi, Via Milite Ignoto, 71, Pesaro, both of Italy

[21] Appl. No.: 517,415

[22] Filed: Apr. 27, 1990

Related U.S. Application Data

[63] Continuation of Ser. No. 240,382, Aug. 30, 1988, abandoned, which is a continuation of Ser. No. 884,646, Jul. 11, 1986, abandoned.

[30] Foreign Application Priority Data

Sep. 2, 1985 [IT] Italy ..... 625 A/85

[51] Int. Cl.[5] ..... H04R 25/00

[52] U.S. Cl. ..... 381/182; 381/158

[58] Field of Search ..... 128/782; 333/200; 381/86, 158, 182, 186, 192, 199, 202, 203

[56] References Cited

U.S. PATENT DOCUMENTS

| | | | |
|---|---|---|---|
| 2,053,364 | 9/1936 | Engholm | 179/110 A |
| 2,259,907 | 10/1941 | Olney | 179/15.5 PS |
| 2,593,031 | 4/1952 | Howatt | 179/110 A |
| 2,857,478 | 10/1958 | Harris | 381/182 |
| 3,155,774 | 11/1964 | Howell | 179/115.5 PS |
| 3,786,202 | 1/1974 | Schafft | 381/190 |
| 4,003,449 | 1/1977 | Bertagni | 381/202 |
| 4,122,315 | 10/1978 | Schroeder et al. | 179/115.5 PS |
| 4,182,429 | 1/1980 | Senzaki | 181/144 |
| 4,283,606 | 8/1981 | Buck | 179/115.5 H |
| 4,298,863 | 11/1981 | Natitus et al. | 340/573 |
| 4,340,835 | 7/1982 | Nakamura et al. | 310/321 |
| 4,365,114 | 12/1982 | Soma | 381/182 |
| 4,401,857 | 8/1983 | Morikawa | 179/110 A |
| 4,418,248 | 11/1983 | Mathis | 179/110 A |
| 4,497,981 | 2/1985 | House | 179/110 A |
| 4,554,414 | 9/1985 | House | 381/182 |
| 4,574,906 | 3/1986 | White et al. | 381/158 |
| 4,672,675 | 6/1987 | Powell et al. | 381/182 |

FOREIGN PATENT DOCUMENTS

| | | | |
|---|---|---|---|
| 2417229 | 10/1979 | France | 381/88 |
| 5154899 | 12/1980 | Japan | 381/182 |
| 0172174 | 10/1958 | Sweden | 381/182 |

*Primary Examiner*—Curtis Kuntz
*Assistant Examiner*—William Cumming
*Attorney, Agent, or Firm*—Leonard Bloom

[57] ABSTRACT

A multiple loudspeaker includes a housing and a first speaker (a woofer) supported by the housing. The first speaker includes a first diaphragm. A support for supporting a second speaker (a tweeter) is provided, and the tweeter support is supported by the housing. A portion of the support for the tweeter is spaced from the first diaphragm (the woofer diaphragm), and the tweeter is spaced from the woofer diaphragm. The tweeter support can be in the form of a protective grill or in the form of an annular ring. A sponge damper is attached to the spaced portion of the tweeter support. The tweeter includes a second diaphragm (the diaphragm for the tweeter) and a piezoelectric transducer. The tweeter diaphragm is attached to and is supported by the sponge damper. The piezoelectric transducer is attached to and supported by the tweeter diaphragm and is spaced from the woofer diaphragm. The piezoelectric transducer faces and is spaced from the woofer without an obstruction being present between the piezoelectric transducer and the woofer diaphragm. The surface of the woofer diaphragm reflects the sound waves emitted from the rear of the piezoelectric transducer and the rear of the tweeter diaphragm.

9 Claims, 2 Drawing Sheets

MULTIPLE LOUDSPEAKER

This application is a continuation of application Ser. No. 240,382, filed Aug. 30, 1988, now abandoned which is a continuation of application Ser. No. 884,646 filed Jul. 11, 1986 now abandoned.

BACKGROUND OF THE INVENTION

This invention concerns a multiple loudspeaker with a piezoelectric "tweeter", held up by means of support which allows the rear wave emitted by the ceramic disk and respective conical diaphragm to be reflected, using the main loudspeaker cone as a reflecting surface without overloading the moving coil of the main loudspeaker.

A multiple loudspeaker, such as a combined "woofer" and "tweeter" speaker arrangement where the "woofer" is primarily for lower frequency sounds and the "tweeter" is primarily for higher frequency sounds is referred to as a "biphonic" speaker system.

For further explanation of the loudspeaker, according to the invention, we feel it is necessary to give a brief description of the current technological situation in the field of acoustic reproducers.

In order to faithfully reproduce high frequencies, a loudspeaker should have a fairly small cone, while on the other hand, low frequency reproduction requires a cone of considerable dimensions; therefore when an optimum performance needs to be obtained, instead of using just one loudspeaker intended to reproduce the whole range of audio-frequencies with fidelity, an ensemble of several loudspeakers suitably arranged is usually adopted: some with large dimensions suitable for low frequency reproduction, normally called "woofers", other with small dimensions suitable for high frequency reproduction, normally called "tweeters".

The multiple loudspeakers' group includes bi-phonic coaxial loudspeakers which have two reproduction appliances totally independent of each other but coaxially mounted, one equipped with a bigger cone, the other equipped with a smaller cone placed immediately in front of and on the same axis as the bigger cone.

In some prior art bi-phonic coaxial loudspeakers, a piezoelectric "tweeter" is adopted, namely using a ceramic disk generator of sound waves, situated inside a small protection and support basket, which is attached to a part of the main loudspeaker frame (i.e. the bigger loudspeaker), according to various construction solutions: in some models the basket is supported by an axial pin, while in other models a support bracket is adopted made up of one or more radial spokes the end of which is to be positioned and fixed on the main loudspeaker basket.

Both construction solutions in the prior art just described present some common problems and some specific problems.

For example the abovementioned central support pin is not mechanically reliable; especially taking into account the economic material used for its manufacture which is mainly plastic barely resistant to the temperature, it can bend laterally until it touches the main loudspeaker coil, which results in friction between the parts which come into contact with each other and immediately causes an inadmissible crackling noise, if not at the very worst, the blockage of the bigger diaphragm.

Moreover both support systems mentioned do not allow the installation of the "tweeter" completely inside the main loudspeaker diaphragm in such a way that the edges of the two maximum diameter sections of the two cones are actually coplanar. This is due to the overall dimensions of the protection and support basket of the piezoelectric "tweeter".

However the most serious problem, which can occur in both prior art systems examined so far, lies in the fact that due to the presence of the aforementioned support basket, the sound waves emitted from the rear by a ceramic disk and by a conical diaphragm of the piezoelectric tweeter cannot be fully taken advantage of for contributing to sound quality. If these sound waves could be reflected forwards, the actual radiation impedance of the sound source would be increased.

SUMMARY OF THE INVENTION

This invention concerns a multiple loudspeaker with a piezoelectric "tweeter", held up by a means of support which allows the rear wave emitted by the ceramic disk and respective conical diaphragm to be reflected, using the main loudspeaker cone as a reflecting surface without overloading the moving coil of the latter.

The invention is basically characterized by the fact that the piezoelectric "tweeter" is placed in front of the main loudspeaker cone, without the traditional protection and support basket, but using a different means of support which does not intercept or disturb the rear radiation from the piezoelectric "tweeter", or prevent the forward reflection of the radiation by the main loudspeaker diaphragm.

Bearing this in mind, an alternative prior art solution to the two abovementioned solutions has already been proposed, whereby the support of the piezoelectric tweeter is in a coaxial position in front of the main loudspeaker cone.

According to this alternative solution, the piezoelectric tweeter is not situated inside a basket, but its ceramic disk is firmly joined to the mobile support of the main loudspeaker coil, the diaphragm of which can then act as a reflecting surface for the radiations emitted from the rear by the tweeter cone, but not for those radiations emitted by the ceramic disk fixed to the mobile support of the main loudspeaker coil.

In addition to the limited exploitation of the waves emitted from the rear by the piezoelectric tweeter, the last solution indicated obviously brings about an overloading of the mobile support of the main loudspeaker coil. Even if this is minimal, an increase in the size of the magnet is nevertheless necessary, which leads to a notable increase in the final production costs.

The aim of this invention is to provide a means of support for the piezoelectric "tweeter", which, without overloading the mobile support of the main loudspeaker coil, allows the exploitation of the radiation emitted from the rear by the ceramic disk and that emitted by the cone. The diaphragm behind the main loudspeaker acts as a reflecting surface, and furthermore the overall dimensions of the piezoelectric "tweeter" are limited in such a way that the whole of the latter can fit into the main loudspeaker cone.

According to this invention, the solution is based on the fact that the piezoelectric "tweeter" is placed in front of the main loudspeaker cone without the usual support and protection basket. A different means of support is used instead, which does not intercept or disturb radiation emitted from the rear by the piezoelectric "tweeter" or obstruct the forward reflection of said radiation by the main loudspeaker diaphragm.

In accordance with a preferred embodiment of the invention, relating to the field of coaxial biphonic loudspeakers, the piezoelectric "tweeter", without a basket, is supported by a spider-shaped bracket with radial spokes, the ends of which are fixed to the main loudspeaker basket.

In accordance with an alternative embodiment of the invention, in the field of coaxial bi-phonic loudspeakers, the piezoelectric "tweeter" is fixed on the back of the protection grille which usually covers the hole on the front of the panel on which the loudspeaker is mounted.

BRIEF DESCRIPTION OF THE DRAWING

In order to provide further explanation, the description of this invention proceeds with reference to the enclosed drawings in which two preferred embodiments of the invention at reference are schematically illustrated, to be applied in the field of biphonic, coaxial loudspeakers.

DESCRIPTION OF THE PREFERRED EMBODIMENTS

Figure 1:
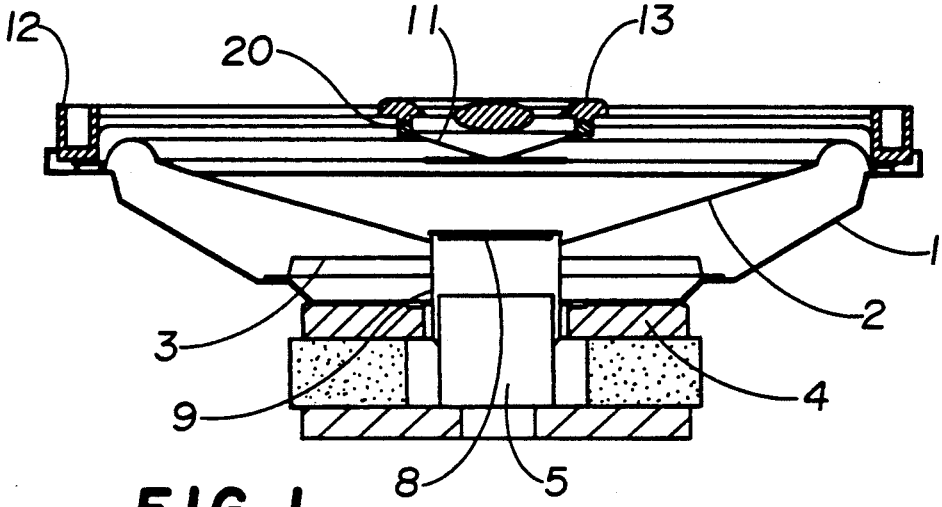
FIGS. 1 and 2 are a section with the axial plan of a biphonic, coaxial loudspeaker, in accordance with the invention and with its preferred embodiment.

With reference to the abovementioned figures, the loudspeaker at reference is made up of two independent reproduction devices coaxially mounted, and in conformity with traditional construction methods for biphonic coaxial loudspeakers.

The main moving-coil loudspeaker suitable for the reproduction of medium to low frequencies is made up of a basket (1), which supports the cone diaphragm (2) internally and the centering device (3), which while allowing the coil to move longitudinally, ensures that it is always perfectly centered in the air gap and that it does not touch the two pole shoes; the external one being ring shaped (4) and the internal one cylindrical (5).

Number (8) indicates an anti-dust plate which closes at the front the mobile support sleeve or voice coil bobbin (9) of the coil assembly, not shown in the figure.

Figure 3:
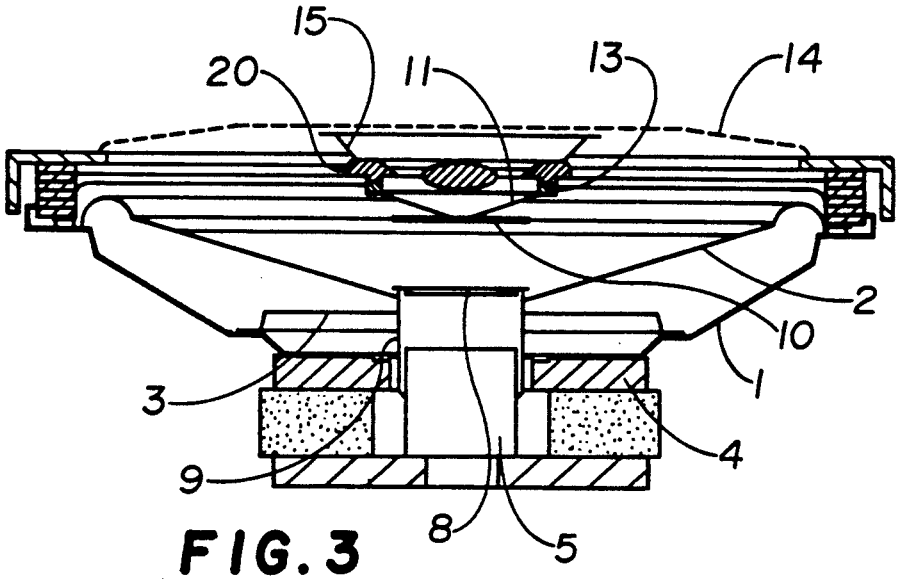
FIGS. 3 and 4 are a section with an axial plan, and a top cut-away view, respectively, of a biphonic coaxial loudspeaker in accordance with the invention and with an alternative embodiment.
Figure 4:
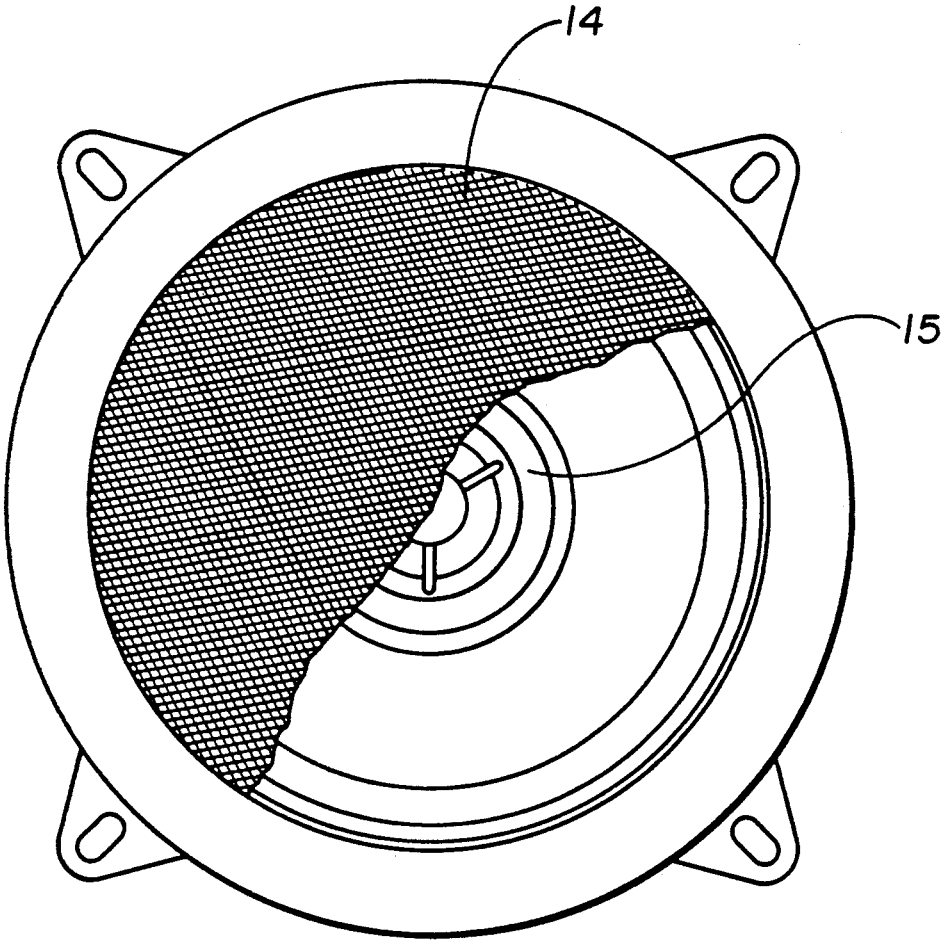

With reference to FIGS. 3 and 4, the other smaller piezoelectric loudspeaker (an acoustic transducer) suitable for high frequency reproduction, is characterized by the fact that it is made up of the ceramic disk (10) and its respective cone (11) only, which are held in a position coaxial to and in front of the diaphragm (2) of the main loudspeaker, by means of a support bracket (12) which in turn is made up of a central annular flange 20 from which one or more radial spokes branch out, level with the flange 20, the ends of which are linked up with the main loudspeaker support basket (1).

More precisely, at the point where the diameter is greatest, the cone (11) of the piezoelectric "tweeter" is glued by its edge to a sponge ring (13), acting as a damper, which in turn is glued onto the back of the aforementioned central annular flange 20.

With reference to FIG. (2), according to an alternative embodiment of the invention, it can be noted how the piezoelectric "tweeter" is supported in a coaxial position in front of the main loudspeaker diaphragm (2) by means of the protection grille (14), which usually covers the hole on the front panel on which the loudspeaker is mounted.

Figure 2:
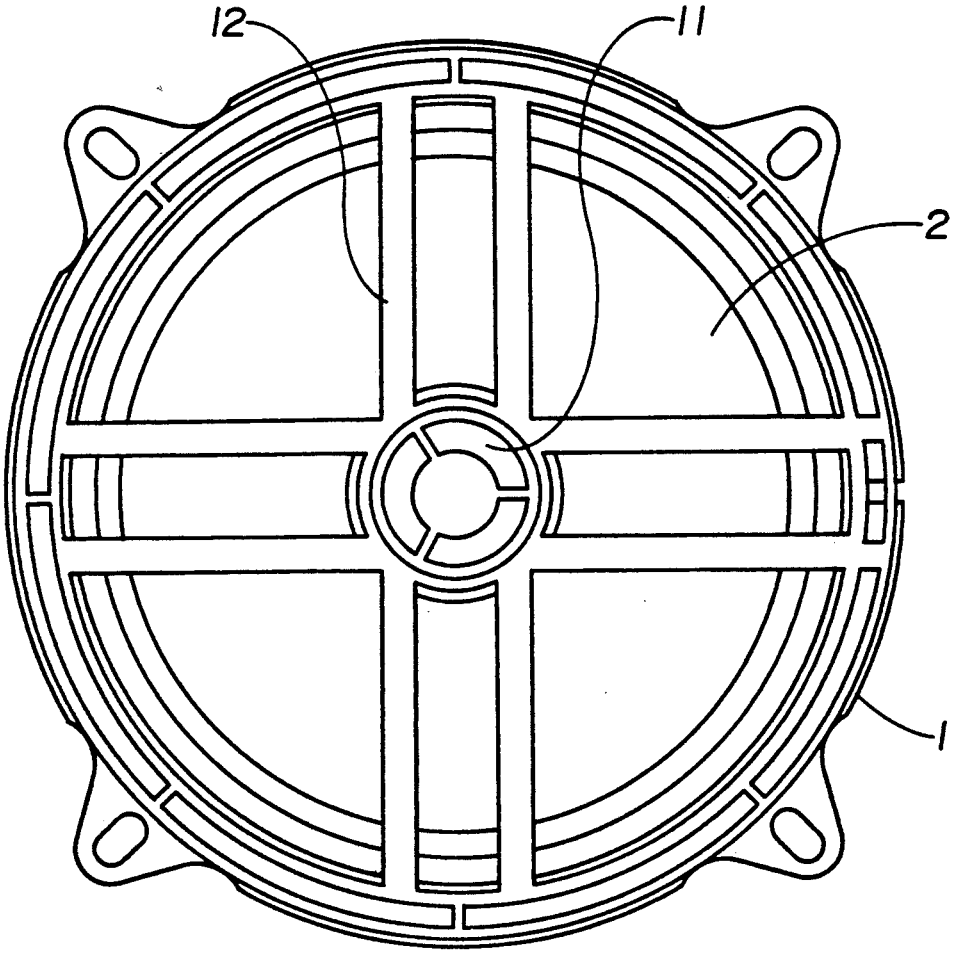

In this alternative version, the sponge ring (13), to which the edges of the piezoelectric "tweeter" cone (11) are to be attached, is glued to a surface especially provided for the purpose, on the inside of the grille (14). Said grille, as per the example put forward by the construction solution in FIG. 2, could even have a horn (15) on the outside of the opening of which, the aforementioned sponge ring (13) may be glued.

Needless to say this description refers to the enclosed drawings, reproduced for explanatory purposes only, and relating to the manufacture of biphonic, coaxial loudspeakers. It is , however, obvious that the invention may be applied in the field of multiple loudspeakers in general, not necessarily biphonic and/or coaxial, without actually deviating from the concept of this invention and the protection afforded by this industrial patent right.

We claim:

1. A multiple loudspeaker, comprising:

housing means having a top and a bottom, first speaker means supported by said housing means, said first speaker means including first diaphragm means having an inner surface and first acoustic transducer means, second speaker support means supported by the top of said housing means, a portion of said second speaker support means spaced from said first speaker means, second speaker means including second diaphragm means attached to said spaced portion of said second speaker support means, and piezoelectric means attached to said second diaphragm means between said second diaphragm means and said first speaker means, said piezoelectric means and second diaphragm means being spaced from said first speaker means and in unobstructed acoustic communication therewith so that acoustic waves emanating from said piezoelectric means and said second diaphragm means radiate unobstructed to the inner surface of said first diaphragm means of said first speaker means and are reflected forward from said first speaker and outside the multiple loudspeaker, and attaching means for attaching only the top of said second diaphragm means to said spaced portion of said second speaker support means, said attaching means including a central annular flange supporting said second diaphragm means, whereby said second speaker means is spaced from said first speaker means.

2. The multiple loudspeaker described in claim 1, wherein said second speaker support means includes a protection grill.

3. The multiple loudspeaker described in claim 1, wherein said means for attaching said second diaphragm means to said spaced portion of said second speaker support means includes damper means.

4. The multiple loudspeaker described in claim 3, wherein said damper means includes sponge damper means.

5. The multiple loudspeaker described in claim 3, wherein said damper means is comprised of a sponge ring.

6. A multiple speaker, comprising:

a tweeter consisting essentially of a piezoelectric transducer and a tweeter diaphragm, a woofer comprised of a woofer transducer and a woofer cone, means for supporting and spacing said tweeter from an inner surface of said woofer cone and for supporting said tweeter with an annular space open around said tweeter, said tweeter support means located at the top of said tweeter diaphragm, said tweeter diaphragm being supported by said tweeter support means, thereby providing an obstruction free space between the rears of said tweeter diaphragm and said piezoelectric transducer and the inner surface of said woofer cone, whereby sound radiations emitted from the rear of the piezoelectric transducer and tweeter diaphragm are reflected by the inner surface of said woofer cone and spread directly outside the speaker by crossing the annular space open around said tweeter.

7. The multiple loudspeaker described in claim 6, wherein said tweeter support means includes a protection grill.

8. The multiple loudspeaker described in claim 6, wherein said tweeter support means includes a central annular flange.

9. The multiple speaker described in claim 6, wherein said tweeter is suspended from said tweeter support means.

* * * * *